US005348347A

United States Patent [19]

Shink

[11] Patent Number: 5,348,347

[45] Date of Patent: Sep. 20, 1994

[54] PORTABLE PHONE ORGANIZER

[75] Inventor: Joe Shink, Valencia, Calif.

[73] Assignee: Auto-Shade, Inc., Moorpark, Calif.

[21] Appl. No.: 97,459

[22] Filed: Jul. 26, 1993

[51] Int. Cl.[5] ..... B42D 1/00

[52] U.S. Cl. ..... 281/31; 281/15.1; 281/51; 402/80 R; 206/38; 206/576; 294/146; 379/426; 379/446; 455/89; 455/90

[58] Field of Search ..... 402/70, 80 R; 281/15.1, 281/29, 31, 51; 40/537, 159, 405; 206/38, 214, 224, 371, 576, 220, 305; 248/205.2; 3505/311.2; 150/131, 135, 139, 143; 190/102; 224/901; 294/146; 379/426, 446, 454, 455, 447, 437; 455/89, 90

[56] References Cited

U.S. PATENT DOCUMENTS

| | | | |
|---|---|---|---|
| 2,223,560 | 12/1940 | Friedlaender | 281/51 X |
| 2,228,457 | 1/1941 | Hoople | 281/51 |
| 3,267,980 | 8/1966 | Bird | 150/135 |
| 3,503,141 | 3/1970 | Schwartz | 281/31 X |
| 4,075,702 | 2/1978 | Davies | 206/305 X |
| 4,296,945 | 10/1981 | Pavlik | 150/143 X |
| 4,465,305 | 8/1984 | Bateman et al. | 281/31 |
| 4,555,018 | 11/1985 | Cho | 206/224 X |
| 4,630,843 | 12/1986 | Willat | 281/31 X |
| 4,771,927 | 9/1988 | Ventura | 224/901 X |
| 4,838,724 | 6/1989 | Spence, Jr. | 281/31 X |
| 4,840,258 | 6/1989 | Tomikawa et al. | 190/102 |
| 5,058,736 | 10/1991 | Bedol | 281/31 X |
| 5,069,567 | 12/1991 | Fink et al. | 402/80 R X |
| 5,209,592 | 5/1993 | Bedol | 402/80 R X |
| 5,219,239 | 6/1993 | Bianco | 402/80 R X |
| 5,232,301 | 8/1993 | Bianco | 281/51 X |

*Primary Examiner*—Mark Rosenbaum
*Assistant Examiner*—Frances Han
*Attorney, Agent, or Firm*—Blakely, Sokoloff, Taylor & Zafman

[57] ABSTRACT

A pocketbook size organizer that can store a portable cellular phone. The organizer comprises a flexible book which has a first cover portion that can fold onto a center cover portion and a second cover portion that folds onto the first cover portion. The book has hook and loop material that fastens the second cover to the first cover to secure the organizer in a folded condition. The inside of the first cover has a pair of straps that secure the portable phone to the book. The straps are attached together by hook and loop material which allows the organizer to carry phones having different outer dimensions. The book also contains a pocket which can receive a calculator and a slit that can capture a note pad. The organizer can be carried by a handle which is attached to the book and has a free end that can be coupled to the outer surface of the center cover by hook and loop material.

9 Claims, 2 Drawing Sheets

PORTABLE PHONE ORGANIZER

BACKGROUND OF THE INVENTION

1. FIELD OF THE INVENTION

The present invention relates to a pocket organizer which can store various items such as a portable phone and a calculator.

2. DESCRIPTION OF RELATED ART

The advent of satellite communications has provided the technology for remote phone systems commonly referred to as cellular phones. Cellular phones allow the user to place and receive phone calls from remote locations. Portable cellular phones are typically carried about freely, without the use of a carrying case or bag. Such a means of transporting the phone may result in the phone becoming damaged or lost. For example, it is not unusual to bring a portable phone to a meeting and place the phone on a table or the floor. Placing the cellular phone on a table exposes the phone to damage from other people in close proximity to the device. Additionally, the user may have a variety of other items which are collected at the end of the meeting. The user may inadvertently forget to take the phone or one of the other items. It would therefore be desirable to have a holder which can store and carry a portable cellular phone. It would also be desirable if the holder could also carry other items such as a note pad and a calculator in an organized manner.

SUMMARY OF THE INVENTION

The present invention is a pocketbook size organizer that can store a portable cellular phone. The organizer comprises a flexible book which has a first cover portion that can fold onto a center cover portion and a second cover portion that folds onto the first cover portion. The book has hook and loop material that fastens the second cover to the first cover to secure the organizer in a folded condition. The inside of the first cover has a pair of straps that secure the portable phone to the book. The straps are attached together by hook and loop material which allows the organizer to carry phones having different outer dimensions. The book also contains a pocket which can receive a calculator and a slit that can capture a note pad. The organizer can be carried by a handle which is attached to the book and has a free end that can be coupled to the outer surface of the center cover by hook and loop material.

It is therefore an object of the present invention to provide a pocket organizer which can carry a portable cellular phone and various other items such as a calculator and a note pad.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
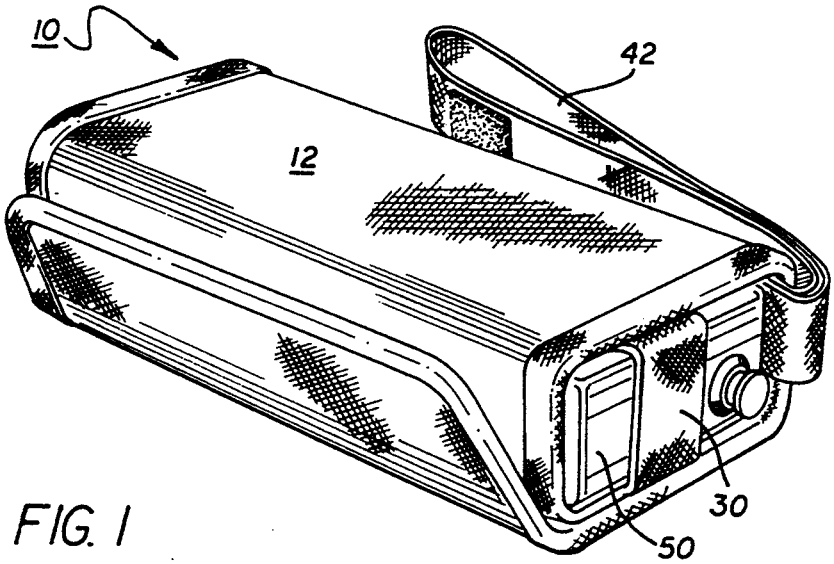
FIG. 1 is a perspective view of a pocket organizer which can carry a portable cellular phone.
Figure 2:
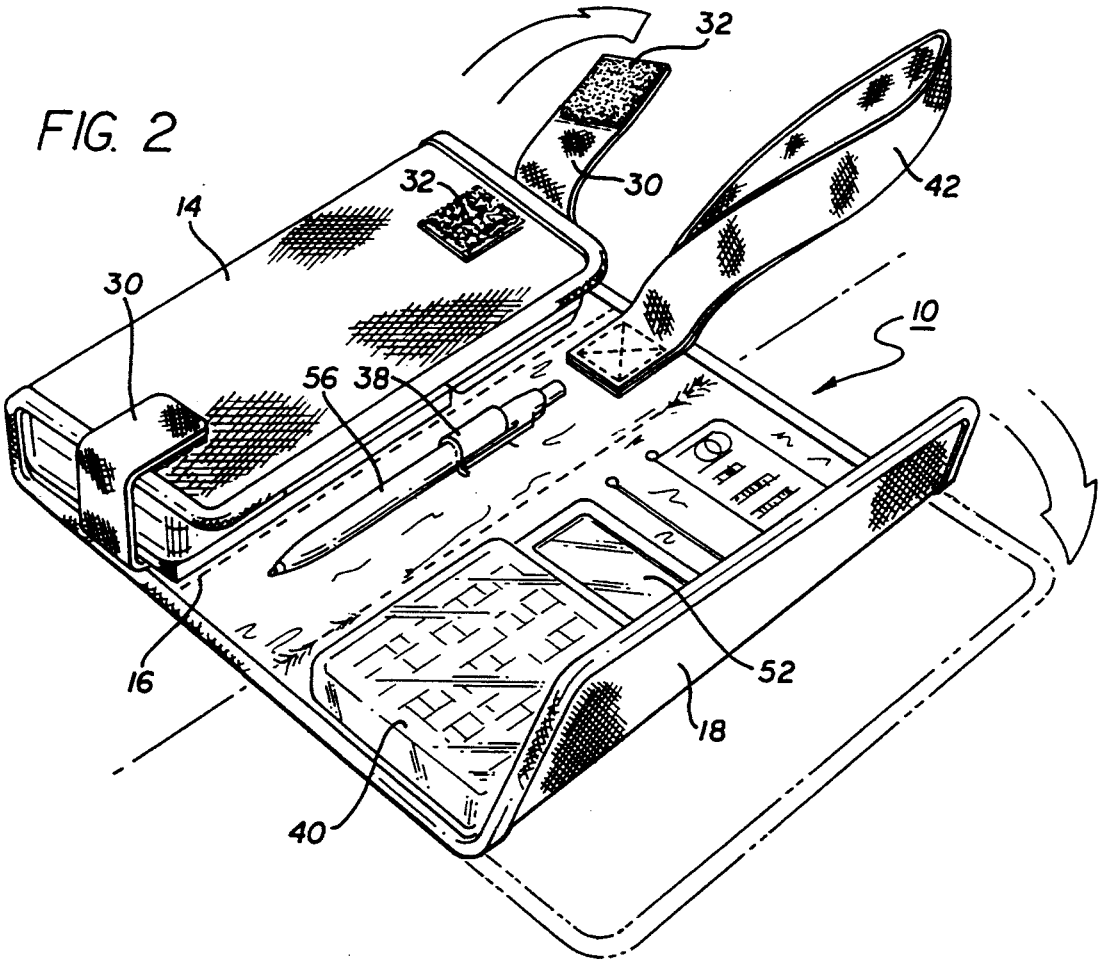
FIG. 2 is a perspective view showing the organizer in a partially closed position.

Referring to the drawings more particularly by reference numbers, FIGS. 1–4 show an organizer 10 of the present invention. The organizer 10 comprises a flexible book 12 which has a first cover portion 14 that can fold onto a center cover portion 16 and a second cover portion 18 which can fold onto the first cover portion 14. The outer surface 20 of the first cover 14 and the inner surface 22 of the second cover 18 may have matching patches of hook and loop material 24 which attach the second cover 18 to the first cover 14 and secure the book 12 in a folded condition. The flexible book 12 is typically constructed with an outer layer of fabric and an inner layer of vinyl material.

The first cover 14 has a pair of phone straps 26 that are coupled together by hook and loop material 28. The hook and loop material 28 allows the straps 28 to be adjusted to vary the size of the opening formed by the straps 26.

The organizer 10 also has a pair of secondary straps 30 that extend from the center cover portion 16. The straps 30 can be attached to the first cover portion 14 by matching hook and loop material 32. The center cover 16 has a first slit 34 and a plurality of second slits 36 that each form a number of pockets. The center section 16 also has a pen strap 38.

Figure 4:
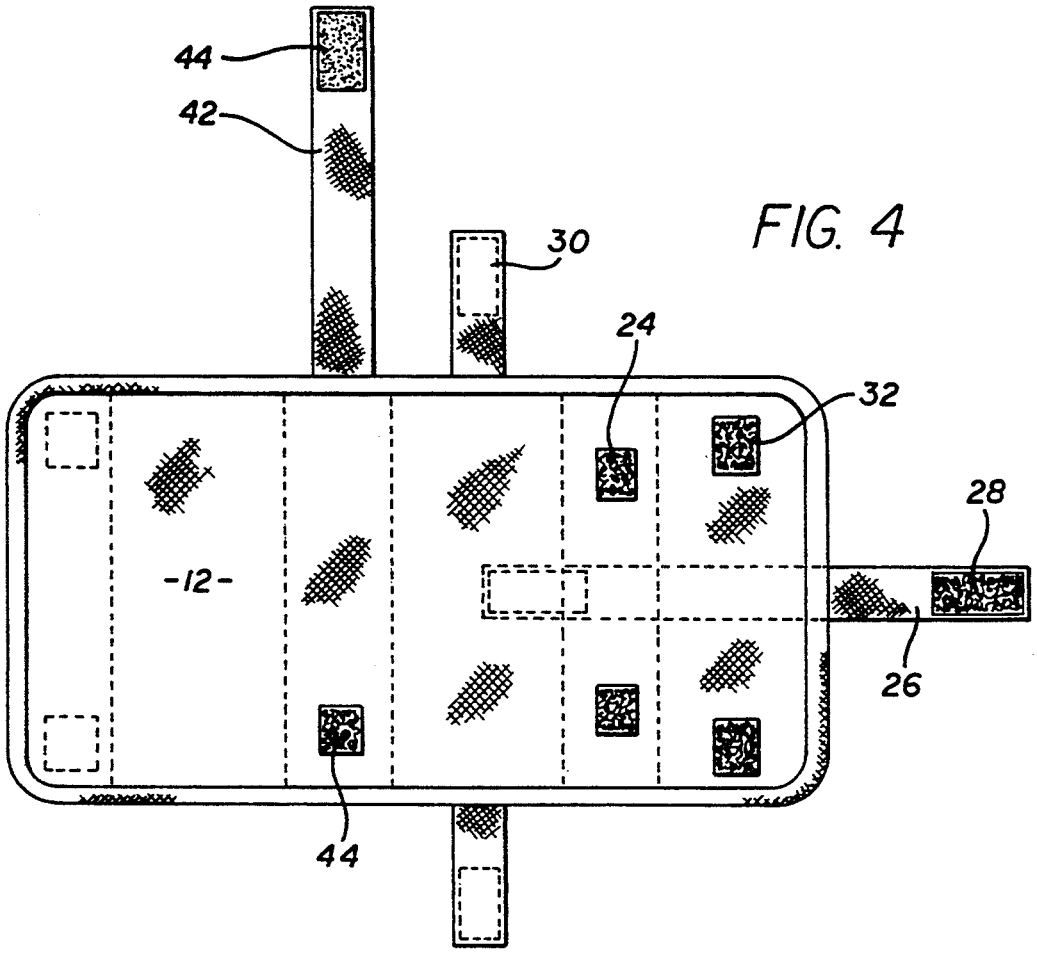
FIG. 4 is a bottom view the organizer in the unfolded position.

The second cover 18 has a pocket 40 and a plurality of second slits 36 that also form a number of pockets. As shown in FIG. 4, the book 12 has a handle strap 42 that has a free end attached to the outer surface of the center portion by hook and loop material 44. The hook and loop material 44 allows the handle 42 to be secured to the book 12 when the strap 42 is not being used.

Figure 3:
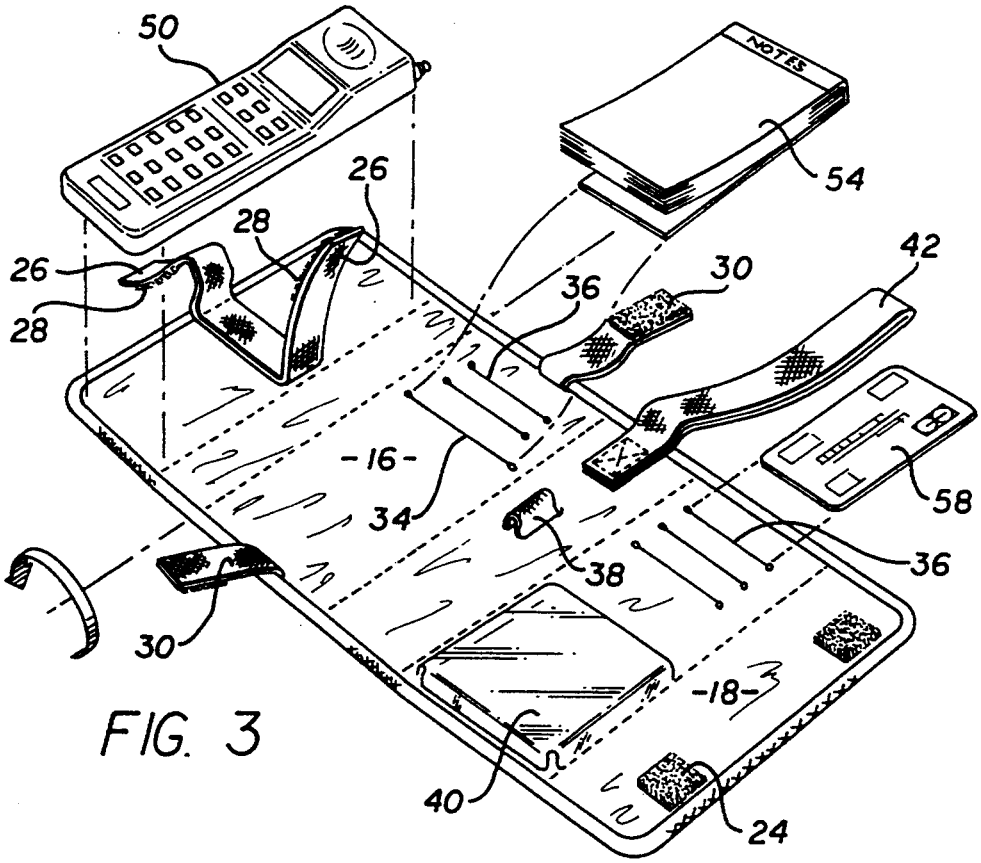
FIG. 3 is a top view of the organizer in an unfolded position.

As shown in FIG. 3, the phone straps 26 can secure a portable cellular phone 50 to the book 12. The hook and loop material 28 allows the straps 26 to be adjusted to compensate for phones that have varying outer dimensions. As shown in FIG. 1, the secondary straps 30 prevent the phone 50 from falling out of the organizer 10. The pocket 40 can hold a calculator 52 or other similar size item. The first slit 34 and accompanying pocket are typically of a size and depth to capture the backing of a note pad 54. The pen strap 38 can hold a pen 56. The second slits 36 typically have a width and depth to receive a number of credit cards 58.

The organizer 10 can be folded to cover and protect the various items, particularly the phone 50. The organizer 10 also provides a number of different items that are commonly used with a phone, such as a note pad 54 and a pen 56. The present invention thus provides a organizer which provides ready easy access to a portable cellular phone and a number of other items, such that the phone and items are easy to both carry and store.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A portable phone organizer book that can hold a portable phone, a calculator and a note pad, comprising:

a flexible book which has a first cover portion that can fold onto a center cover portion and a second cover portion that can fold onto said first cover portion, said flexible book having a first slit that is adapted to capture the note pad;

a phone strap attached to said flexible book and adapted to secure the portable phone to said flexible book;

a pocket attached to said flexible book and adapted to secure the calculator to said flexible book; and, fastening means for attaching said second cover portion to said first cover portion.

2. The organizer as recited in claim 1, further comprising a handle attached to said flexible book.

3. The organizer as recited in claim 2, wherein said handle can be fastened to said flexible book by hook and loop material.

4. The organizer as recited in claim 1, further comprising a pen strap attached to said flexible book and adapted to secure a pen to said flexible book.

5. The organizer as recited in claim 1, wherein said flexible book has a plurality of second slits that form pockets within said flexible book.

6. The organizer as recited in claim 1, wherein said fastening means is hook and loop material.

7. The organizer as recited in claim 1, wherein said phone strap includes two strap sections that are secured by hook and loop material.

8. The organizer as recited in claim 1, further comprising secondary straps that extend from said center cover portion and can be attached to said first cover portion by hook and loop material.

9. A portable phone organizer book that can hold a portable phone, a calculator, a note pad and a pen, comprising:

a flexible book which has a first cover portion that can fold onto a center cover portion and a second cover portion that can fold onto said first cover portion, said flexible book having a first slit that is adapted to capture the note pad and a plurality of second slits that form a plurality of pockets in said flexible bag;

hook and loop material that can attach said second cover portion to said first cover portion;

a phone strap attached to said flexible book and adapted to secure the portable phone to said flexible book, said phone strap having two strap sections that are secured by hook and loop material;

a pair of secondary straps that extend from said center cover portion and can be attached to said first cover portion by hook and loop material;

a pocket attached to said flexible book and adapted to secure the calculator to said flexible book;

a pen strap attached to said flexible book and adapted to secure the pen to said flexible book; and, a handle attached to said flexible book, said handle having an end that can be attached to said flexible book by hook and loop material.

* * * * *